United States Patent [19]

Briggs

[11] 4,304,378

[45] Dec. 8, 1981

[54] BAG HOLDER

[76] Inventor: Earl C. Briggs, 606 Michigan Blvd., Pasadena, Calif. 91107

[21] Appl. No.: 19,296

[22] Filed: Mar. 12, 1979

[51] Int. Cl.[3] ..... A63B 55/04

[52] U.S. Cl. ..... 248/97; 248/150

[58] Field of Search ..... 248/95, 96, 97, 98, 248/99, 136, 150, 149; 232/43.2; 53/390; 141/390

[56] References Cited

U.S. PATENT DOCUMENTS

| | | | |
|---|---|---|---|
| 400,191 | 3/1889 | Clark | 248/99 X |
| 447,686 | 3/1891 | Holladay | 248/97 |
| 504,787 | 9/1893 | Kountz | 248/97 |
| 1,145,297 | 7/1915 | Erickson et al. | 248/97 |
| 1,350,443 | 8/1920 | Edstrom | 248/97 |
| 1,403,751 | 1/1922 | Edstrom | 248/97 |
| 2,448,821 | 9/1948 | Murphy | 248/97 |
| 2,754,076 | 7/1956 | Westervelt | 248/97 |
| 2,995,329 | 8/1961 | Talcott | 248/97 |
| 3,756,548 | 9/1973 | Santarelli | 248/99 X |
| 3,979,053 | 9/1976 | Ammann | 232/43.2 |
| 4,069,993 | 1/1978 | Shanks | 248/97 |

FOREIGN PATENT DOCUMENTS

| | | | |
|---|---|---|---|
| 247229 | 5/1966 | Austria | 248/97 |
| 705287 | 3/1954 | United Kingdom | 248/97 |

*Primary Examiner*—J. Franklin Foss
*Attorney, Agent, or Firm*—Sellers and Brace

[57] ABSTRACT

A bag holder for holding a plain bag in an open position for filling by supporting in a cuff at the bag opening has a bag support with improved cuff attachment means without accessory bands or clamps for obtaining quick installation and secure retention of the bag, including those made of slippery plastic film. In one construction of the bag support, resilient tensioning means provides nearly constant low force peripheral tensioning of the cuff by three corner grips of appreciable area. Each corner grip has a smoothly curved initial grip surface for holding the outer fold of the cuff tensioned over a smoothly curved snubber grip surface thereby holding the cuff with a self locking action. A grip surfacing on the grip surfaces provides a high grip coefficient for obtaining self locking of the snubber grip when a bag load is applied. The corner grip type cuff attachment wherein the sides of the tensioned cuff span the sides of the bag opening also provides for new frame constructions permitting unobstructed sidewise movement of the bag and further permits more compact folding for stowage by overlap of the parts. In an equivalent grip construction, resilient means in each grip provide the initial grip contact pressure.

20 Claims, 19 Drawing Figures

BAG HOLDER

BACKGROUND OF THE INVENTION

1. Field of the Invention

This invention relates to holders and more particularly to bag holders for holding a bag in an open position with its inlet overturned about support means for filling 2. Description of Prior Art Bag holders for holding a bag in an open position for filling are generally comprised of a frame with a foot connected by a side member to a bag support having a bag attachment means. Bag holders for holding a reusable bag having reinforcements such as grommets around the bag opening for attaching the bag to hooks on the bag support are old in the art.

Plain bags of low cost material such as thin plastic film are now widely used for material handling and as disposable containers for trash collection. Prior art bag holders for plain bags provide various frictional grip cuff attachment means for holding and retaining the bag by a cuff around the bag opening, and generally provide for support under the bottom of the bag to avoid strain on the cuff. Some prior art bag holders obtain cuff retention by the use of clamping elements that require time consuming installation and removal. In the prior art cuff attachment means the cuff tends to slip or tear during normal filling, particularly when used with slippery plastic film bag materials. Normal filling includes tamping to compact the fill material and transport of partially filled bags for material collection.

One early cuff type bag holder is an enclosing can in which the bag is held by folding the cuff over the edge of the can. The can type bag holder is limited to use with light fill material or to partial filling of the bag because the bag expands as filled and tends to lock in the can. A further limitation is that the entering material drags on the inside of the bag and tends to draw the cuff into the can, closing the bag opening.

Later cuff type bag holders provide a supporting frame with a clearance for removal of the filled bag and have various frictional grip cuff attachment means including spring clip and elastic band devices. A bag holder listed on page 1139 of the Sears Roebuck Spring-/Summer 1979 catalog, order no. 11A61836, utilizes an attached elastic band for initially holding the cuff on an annular support having a raised continuous ridge with a smooth narrow edge that acts as a snubber when load is held in the bag. However, the narrow edge tends to cut the cuff during normal filling, the cuff tends to creep over the smooth snubber ridge and release the bag cuff when under load, and the installation of the elastic band is time consuming. Another commercial bag holder manufactured by Pacific Handy Cutter. Inc., 720 W. 17th St., Costa Mesa, Calif. under the trade designation "Quick Trash" uses small plastic spring clips for attaching the outer fold of the bag cuff to multiple vertical legs and shows Patent Pending.

SUMMARY OF THE INVENTION

The present invention provides an improvement in a bag holder for holding and retaining a plain bag, including the plain bag made of a slippery plastic film, in an open position for filling by supporting in a cuff around the bag opening. The invention primarily provides a new cuff attachment means for improved retention of the cuff without the use of accessory bands or clamps.

Increased utility is also provided by improvements in accessibility for bag installation and in foldability for compact stewage related to the new cuff attachment means.

As in the prior art, the bag holder of the invention requires a support providing clearance for installation of the bag and for removal of the filled bag. Generally, a portable frame is used having a foot at its lower part and connecting the bag support with the cuff attachment means and a handle at its upper part. The cuff attachment means provides for releasably attaching the cuff of a particular sized bag preferably at a height allowing support of the bottom of the bag at the foot. The bag is installed by folding the border of the bag opening back over the cuff attachment means to form the bag cuff. The capacity of the cuff attachment means is limited by a failure load at which the cuff material is overstressed and fails, or by a slip load at which the cuff slips from the attachment means.

In the preferred embodiment of the improved cuff attachment means, a corner grip having a raised smoothly curved initial grip surface of appreciable area for holding and tensioning on the outer part of the cuff and having an adjacent coacting smoothly curved raised snubber grip surface of appreciable area for holding the bag load in the fold of the cuff with a locking action grip is disposed on the bag support for localized holding and tensioning in the intalled cuff at each corner of a straight sided bag opening. A generally rectangular bag opening requires four corner grips and a triangular bag opening requires three corner grips. The snubber grip surfaces are of sufficient area with smooth curvature for supporting the applied loads with a uniform grip contact pressure without localized stress concentration thereby increasing the failure load capacity of the bag holder. To obtain localized holding on the grip surfaces, the corner grips are positioned to provide for alignment of the tensioned cuff generally clear of the adjacent frame members. However, when the bag holder is for use with a bulky fill material tending to push against the side of the bag opening and stretch the cuff, a construction is desirable providing a back up support member along at least one side of the bag opening in close parallel proximity inside the cuff.

In construction for general purpose use the corner grip is a freely rotatable knob held on a spindle bearing attachable to the bag support thereby providing for automatic equalization of the peripheral tensioning of the installed bag cuff around the several rotatable knob corner grips. In an alternate construction the knob corner grip is attached on the bag support in a fixed non-rotatable manner for lower cost manufacture, but equalization of the cuff tensioning requires manual adjustment. The knob corner grip has a generally round cylindrical body carrying the initial grip surface, the body having a generally hemispherical top end carrying the snubber grip surface. Either the rotatable or the fixed knob corner grip provides for knob replacement for replacing worn grip surfaces or for changing the grade of the grip surfacing, and further provides for knob attachment at different attachment points on the bag support for holding different sizes bag openings.

An alternate fixed type corner grip construction providing for economy of manufacture utilizes a structural right angle elbow integral in the frame for providing localized raised grip surfaces. The initial grip surface is located on the leg of the elbow generally perpendicular to the plane of the bag opening and the snubber grip surface is located on the leg directed generally parallel to the side of the bag opening.

Additionally in the improved cuff attachment means for assuring uniform retention of the cuff by the corner grips, a controlled tensioning means provides for a nearly constant low tensioning force for resiliently urging at least one movable corner grip to move outward to peripherally tension the outer fold of the installed cuff around the initial grip surfaces of the several corner grips. The controlled tensioning means further provides for retraction of the at least one movable corner grip to permit release or installation of the cuff. By using a low tensioning force, bag release and installation is made easier. To accomplish bag installation, the cuff is placed over all but one of the corner grips and manually tensioned to retract the at least one movable corner grip by deflecting the controlled tensioning means thereby allowing cuff placement over the remaining corner grip. The controlled tensioning means obtains improvement over the prior art in providing a resilient member retractable over an initial deflection distance several times greater than a working travel deflection distance, thereby providing a more nearly constant tensioning force throughout the working travel distance for maintaining a secure grip on the cuff despite size variations in the bag or the bag holder due to manufacturing tolerances and due to variable stretching of the cuff.

One construction of the controlled tensioning means for general use provides a tensioning adjustment in the resilient member whereby the peripheral tensioning can be increased or decreased for varying the tensioning force. Further improvement is provied by a deflection stop for holding the resilient member deflected through the initial deflection distance, thereby requiring retraction through the working travel distance only for cuff installation. In an alternate construction of the tensioning means for application where heavier bag cuff tensioning is used, a releasable latch is provided on the deflection stop for holding the resilient member deflected through the total deflection distance for free cuff installation. Subsequent release of the latch tensions the cuff. In yet another construction providing for economy of manufacture, the tensioning force is selected and fixed in the construction of the resilient member and is not adjustable. In a further simplification of the construction the movable corner grip is retractable through the total deflection distance for bag cuff installation without the use of a deflection stop.

In construction of the controlled tensioning means, the nearly constant peripheral tensioning force is selected in relation to the area of the initial grip surfaces to be within a range low enough to avoid damaging the cuff material and to provide for easy corner grip retraction for cuff installation and removal, yet being high enough to provide for an adequate initial grip on the outer part of the cuff for retention of the empty bag and for anchoring initiation of the exponentially increasing snubbing grip cumulative over the fold of the cuff for holding the cuff in place when load is applied in the bag. The full effectiveness of the snubbing grip is realized when the grip becomes self locking. It is readily understood that development of the self locking snubbing grip is dependent on an adequate grip coefficient between the grip surfaces and the bag material.

In view of the wide usage of plain bags made of slippery surfaced thin film plastic which has relatively low tear strength, the self locking retention of this bag material tests the utility and marketability of the bag holder. In the new bag attachment means when the corner grips have smooth grip surfaces as used on prior art bag holders and are used with a maximum permissible controlled tensioning of the cuff, the grip obtained with thin film plastic bag materials is improved over the prior art but is not consistently self locking. An additional objective is to provide a sufficiently high grip coefficient to assure self locking of the snubber grip.

In the cuff attachment means of the invention it has been discovered that a grip surfacing adhered or integral on the grip surfaces can be provided to increase the grip coefficient to assure self locking of the snubbing grip. One such surfacing having closely spaced numerous sharp points of selected sharpness, height and spacing as on an abrasive cloth provides the required high grip coefficient by mechanically denting and interlocking in the bag material. The close spacing of the sharp points is selected to provide a generally smooth overall surface for supporting the bag material at the applied grip contact pressure without tearing or puncturing. In test models a two pound peripheral cuff tensioning force holding one mil plastic film on a coarse grade abrasive cloth was satisfactory. The surfacing may be adhered on the grip surfaces by commercial processes for blowing or electrostatically depositing the grit into a wet coat of adhesive. Another high coefficient grip surfacing is a tacky pressure sensitive adhesive coating that releases the bag material when contact pressure is removed.

Recapitulating, the disclosed bag attachment means for obtaining a quickly releasable self locking grip on the cuff comprises the controlled tensioning means, the corner grips having coacting initial and snubber grip surfaces, and the high grip coefficient surfacing adhered or integral on the grip surfaces.

Additionally, the principles of the invention are applicable to an equivalent grip construction wherein the initial grip is obtained by pressing the outer part of a folded border on a bag or other structure of thin flexible material against the initial grip surface with a resiliently urged conforming soft pad. One or more of the resilient pad type grips may be used to hold a bag suspended from one side for filling by holding the bag open with one hand while using the other hand for filling.

Further improvement over the prior art bag holders is made possible by the corner grip type cuff attachment. Clampable adjustment or alternate receptacles for changing the positions of the corner grips on the bag support permit holding bags with different sized bag openings. Further, provision for unobstructed access on one side of the bag holder for removal or installation of the bag is made possible by a construction of the bag support wherein the tensioned cuff spans an open unobstructed side. Additionally, the open sided construction of the bag support provides for two extending cuff support arms to be foldable against the frame in an overlapping manner for more compact stowage.

Another object of the invention is to provide corner grip knobs made in accordance with the principles of the invention for use on other holders or for replacement parts.

DESCRIPTION OF THE PREFERRED EMBODIMENTS

Figure 8:
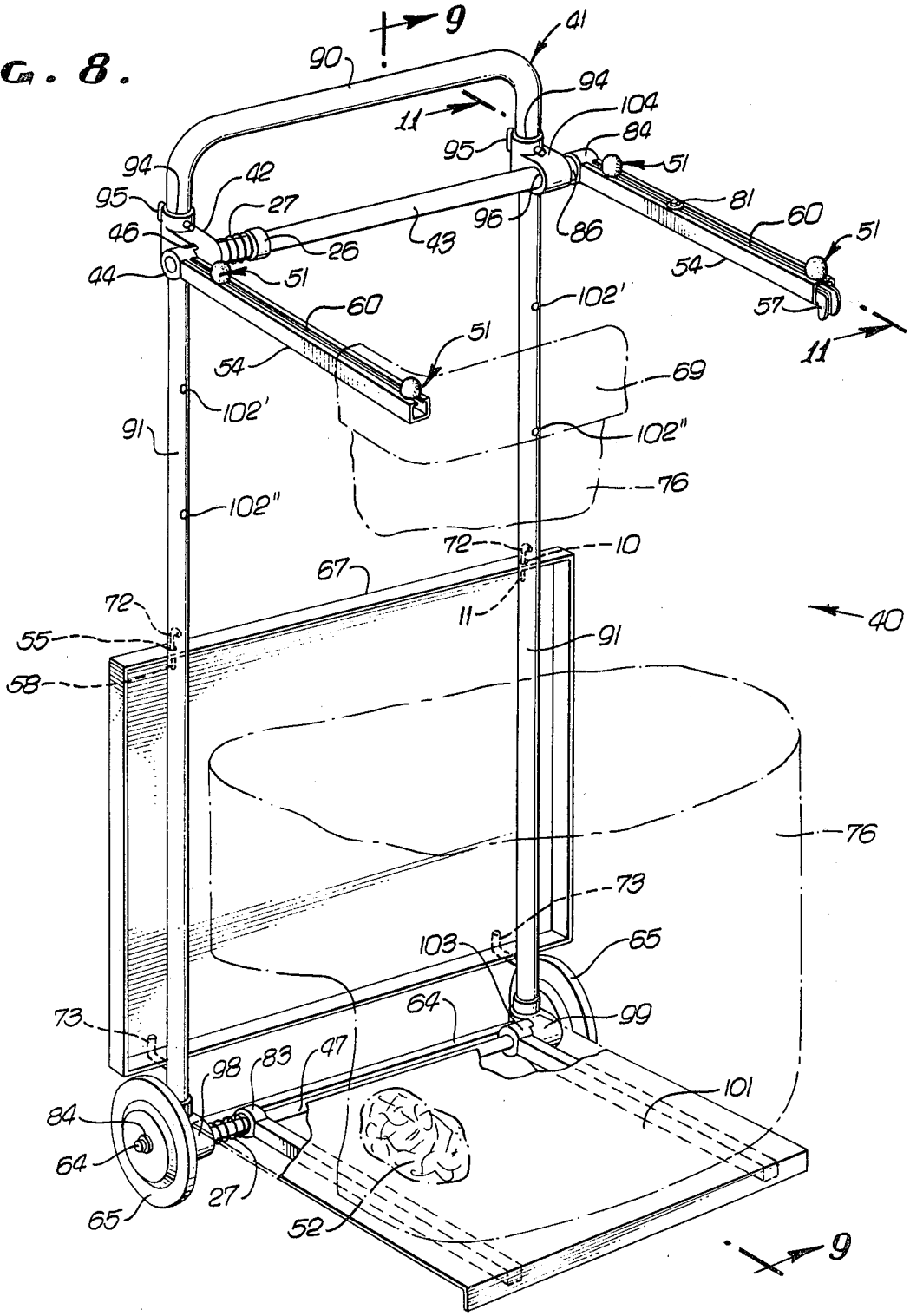
FIG. 8 is a perspective view of a second embodiment of the bag holder wherein the vertical frame has means for connecting a latchably foldable upper support at different heights to hold bags of different lengths.

Referring to the drawings, FIG. 8 shows a bag holder assembly 40 in perspective view utilizing the principles of the invention in the bag attachment means in combination with related improvements in frame construction as set forth additionally on FIGS. 9 through 15.

As seen in FIG. 8, bag holder assembly 40 has a central frame subassembly 41 having right and left hand side members 91 integrally connected at their upper ends by a handle cross member 90 and rigidly interconnected at their lower ends by a lower cross shaft 47 held by a left hand fitting 98 and a right hand fitting 99. The left hand side member 91 carries a slidable fitting 42 having rotational cam recesses 46 at ninety degree spacing and the right hand member 91 carries a slidable fitting 104. Fittings 42 and 104 each have a vertical bore 94 slidable on the side member 91 and are each connectable thereto at a selectable pair of an attachment receptacle 102, 102', 102'' etc. for adapting to hold a bag 76 of a particular length.

Fittings 42 and 104 each additionally have a horizontal bore 96 for rotatably and slidably holding an upper cross shaft 43 extending at each end. The upper cross shaft 43 is retained at its left hand extension by a right angle fitting 44 having cam lock recesses 46 and rigidly connected to a left hand support arm 54 holding two of a rotatable knob corner grip subassembly 51. The cross shaft 43 is similarly retained at its right hand extension by a right angle fitting 84 and rigidly connected to a right hand support arm 54 holding two additional of the rotatable knob corner grip subassembly 51. The mounting, adjusting and tensioning the four rotatable knob corner grip subassemblies 51 for holding a bag 76 for filling by supporting at a bag cuff 69 is described hereinafter.

Figure 12:
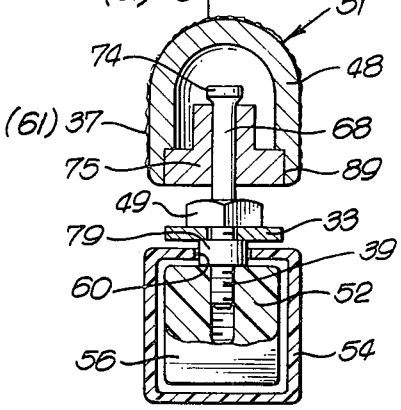
FIG. 12 is a cross sectional view on an enlarged scale taken along line 12—12 on FIG. 11.

The manner of making the rotatable knob corner grip subassembly 51 for providing a self locking grip action for holding in the bag cuff 69 is best seen by reference to FIG. 12. A knob 48 has a cylindrical peripheral grip surface 37 and an adjacent hemispherical coacting snubber grip surface 38, said knob 48 being held on a rotatable bearing 75 by a press fit 89. Bearing 75 is freely rotatable on a spindle 68 and is retained by the upset end 74. The spindle 68 has a central square base 49 for receiving a wrench and a male threaded end 39 for threadable attachment to supports. The grip surfaces 37 and 38 have a grip surfacing 61 to provide an increased grip coefficient.

Figure 11:
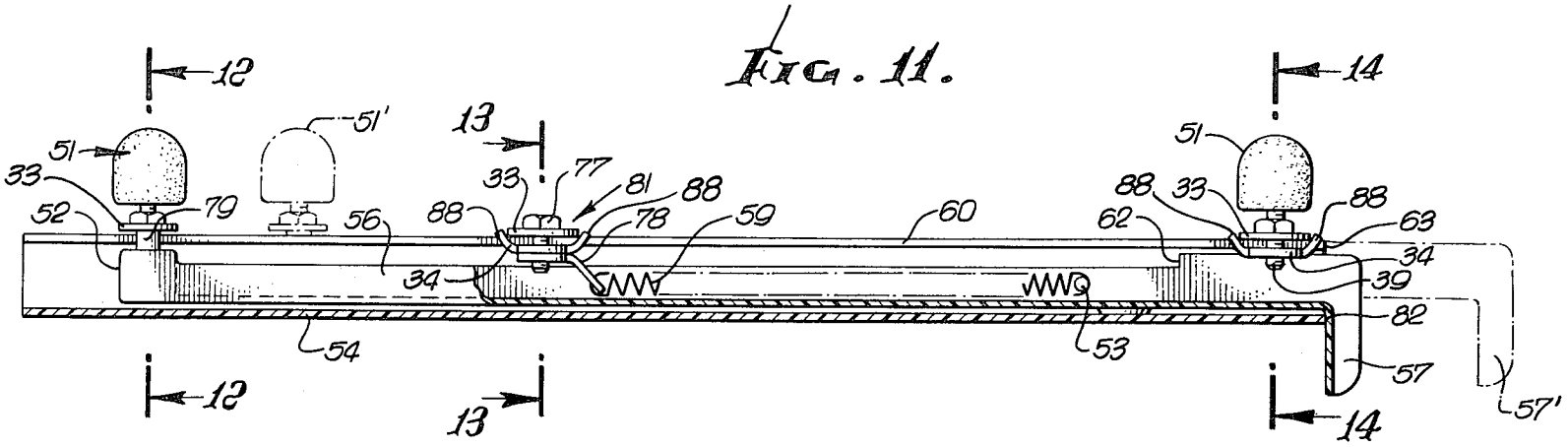
FIG. 11 is a cross sectional view on an enlarged scale taken along line 11—11 on FIG. 8.
Figure 14:
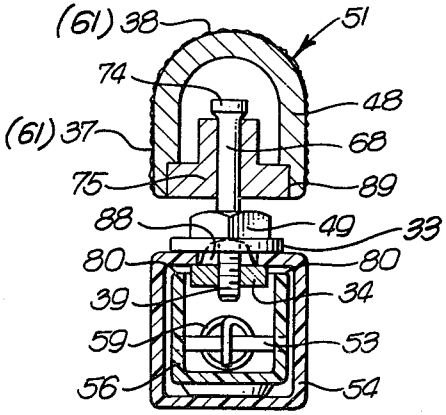
FIG. 14 is a cross sectional view on an enlarged scale taken along line 14—14 on FIG. 11.

Both of the rotatable knob corner grip subassemblies 51 on the left hand support arm 54 and the front rotatable knob corner grip subassembly 51 on the right hand support arm 54 are clampably attached along a lengthwise slot 60 in the upper side of each support arm 54 as can be understood by reference to FIGS. 11 and 14. The threaded end 39 of the knob corner grip subassembly 51 inserts through an upper washer 33 and through slot 60 and threadably connects below the slot 60 to an internal guide nut 34. The guide nut 34 is held from rotating by two end tabs 88 projecting into the slot 60. The three clamped knob corner grip subassemblies 51 are thus slidably adjustable along slot 60 and are clampable at fixed positions by torquing the threaded stud 39 by its square base 49 to clamp the edges of the slot 60 between the internal guide nut 34 and the upper washer 33. The three clamp mounted knob corner grip subassemblies 51 are positioned with relation to a fourth resiliently urged movable corner grip subassembly 51 as described hereinafter for tensioning the particular size of the bag cuff 69.

Figure 13:
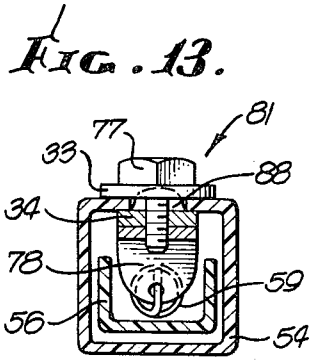
FIG. 13 is a cross sectional view on an enlarged scale taken along line 13—13 on FIG. 11.

FIGS. 11 through 14 detail the arrangement of a resiliently urged latchable slider 56 in the right hand support arm 54 that is retractable and releasably latchable for holding the movable knob corner grip subassembly 51 in a position indicated as 51' for installation of the bag cuff 69. Slider 56 has a generally U shaped cross section as indicated in FIGS. 13 and 14 and slides into support arm 54. A boss 52 at the inner end of slides 56 threadably connects to the threaded end 39 of the knob corner grip subassembly 51. Threaded end 39 passes through an upper guide washer 33 and carries a guide bushing 79 which is slidable in the slot 60 and held between the upper washer 33 and the upper face of the boss 52, thereby transmitting the sliding movement of slider 56 to the movable knob corner grip subassembly 51 carried above slot 60. The outer end of slider 56 has an U shaped section with upper guide edges 80 that terminate at a latch step 62 located to latch on a catch 63 when the knob corner grip subassembly 51 is at the retracted position 51' as indicated on FIG. 11. A handle 57 movable to a position 57′ as also shown on FIG. 11 is provided for retracting the slider 56.

As best seen on FIG. 11, with added detail contributed by FIGS. 13 and 14, slider 56 is resiliently urged inward by a tension spring 59 thereby holding handle 57 against a stop 82 for holding slider 56 at the limit of the inward resiliently urged movement. One end of the tension spring 59 is attached to the outer part of slider 56 on a cross pin 53 and is attached at the other end to support arm 54 by a subassembly 81 that is clampable along the sot 60 for adjustably tensioning the bag cuff 69. Clamp subassembly 81 has a clamp screw 77 holding an external washer 33 and passing through the slot 60 to threadably connect to an internal nut 34 which is held from rotating by end tabs 88 projecting upward into the slot 60. Torquing of the screw 77 brings the washer 33 and the nut 34 together to clamp on the edges of the slot 60. The clamp subassembly 81 has a connector clip 78 threadably connected on the lower part of screw 77 for attaching tension spring 59. Application of spring tension holds the clip 78 from rotation on the screw 77.

Figure 9:
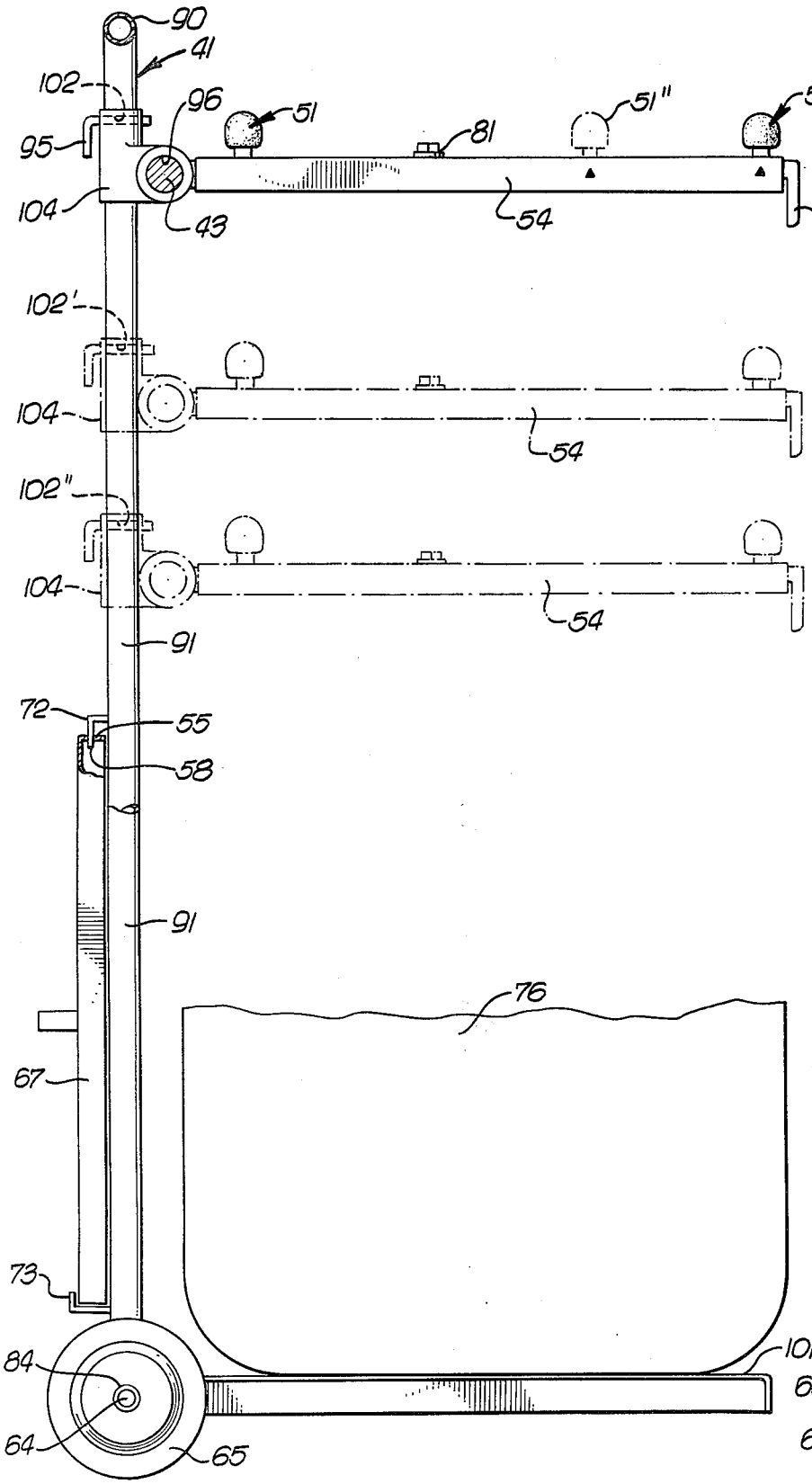
FIG. 9 is a side view of FIG. 8.

Before installing the bag 76 on the bag holder assembly 40, as shown on FIG. 9, the fittings 42 and 104 holding the support arms 54 are slidably adjusted and connected on the frame subassembly 41 at the pair of receptacles 102, 102′, 102″, etc. suitable for the length of the particular bag 76. This adjustment provides for holding bags 76 of different lengths so the bottom of the bag 76 is supported on a platform 101 for holding tamping forces that would tend to damage the bag 76 if transmitted upward to the bag cuff 69. Additionally before installing the bag 76, the three fixed knob corner grip assemblies 51 are adjusted and clamped along the slots 60 in positions as indicated at 51″ on FIG. 9 suitable for holding the particular size of the bag cuff 69.

To install the bag cuff 69, the movable knob corner grip subassembly 51 is retracted to the position 51′ indicated on FIG. 11 by pulling the slider 56 outward against the resilient urging of the spring 59 by using the handle 57 and then moving the handle 57 upward to engage the latch step 62 on the catch 63 to hold the retracted position. When the fixed knob corner grip subassemblies 51 are clamped at their proper positions, the bag cuff 69 can be installed without additional retraction of the slider 56 when latch step 62 is engaged. Subsequent release of the latch step 62 tensions the bag cuff 69 around the several corner grip surfaces 37 for initiating the locking action grip over the snubber grip surfaces 38 which secures the bag 76 when a load is applied by a fill material 52. If the bag cuff 69 cannot be freely installed at the retracted position of the slider 56, a least one of the fixed knob corner grip subassemblies 51 is repositioned and clamped on the slot 60 to reduce the peripheral distance around the four corner grip subassemblies 51. If the handle 57 closes against the stop 82 before the bag cuff 69 is fully tensioned, at least one fixed knob corner grip subassembly 51 is repositioned to extend the peripheral distance.

Figure 10:
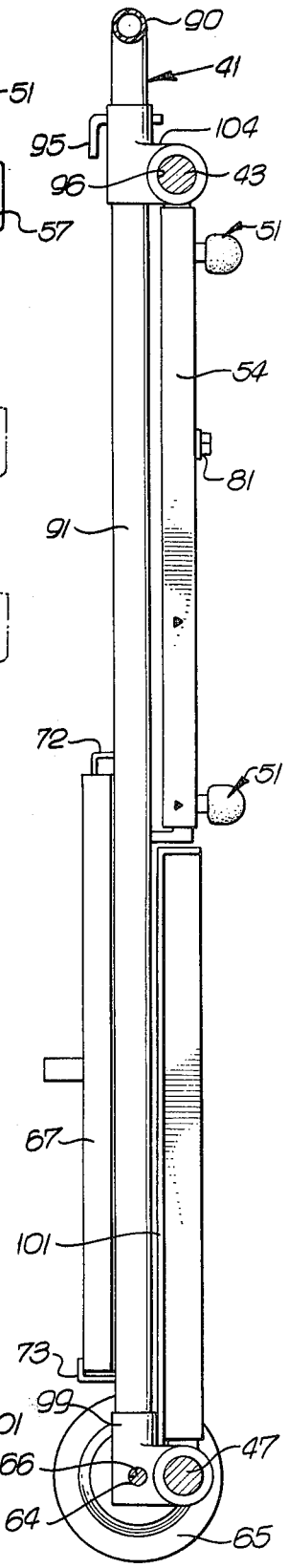
FIG. 10 is a side view of the bag holder of FIG. 8 folded for storage.

Bag holder assembly 40 is foldable from the extended position for use as shown on FIG. 9 to the storage position shown of FIG. 10 by rotating the support arms 54 downward by turning the upper cross shaft 43 and rotating the support foot 101 upward by turning the lower cross shaft 47. At the lower attach points as at 102″ the support arms 54 overlap the platform 101 when folded. The construction and use of the releasable rotational lock for locking the shafts 47 and 43 in either position is best understood by reference to FIG. 8 and the exploded view of FIG. 15. The rotational position of the upper cross shaft 43 with the arms 54 is lockable by the engagement of a set of lock fingers 45 on the left hand shaft fitting 44 in the cam recesses 46 in the left hand fitting 42. Engagement of the lock 45 is made by sidewise sliding of the shaft 43 to the right as urged by a compressed spring 27 on shaft 43 bearing against the fixed fitting 42 and acting against a fixed shaft collar 26 on the shaft 43. Disengagement of the lock 45 to permit folding or extending the support arms 54 is accomplished by sliding the shaft 43 to the left against the urging of the spring 27 as permitted by an end clearance 86. The rotational position of the lower cross shaft 47 with the support platform 101 is held by a rotational lock construction similar to that on the upper cross shaft 43. The lock fingers 45 are on the sliding fitting 103 and the cam recesses are in the fixed fitting 99 at the right hand part of shaft 47. The compression spring 27 bears between the fixed fitting 98 and a sliding fitting 83 urging the attached platform 101 to slide to the right for lock engagement. Lock release for folding or extending the platform 101 is accomplished by moving the platform 101 to the left along shaft 47 against the urging of the spring 27.

For repeated rapid installation of a bag 76 of a standard size, the clampably attached rotatable knob corner grip subassemblies 51 may be positioned so retraction over a short working distance deflection permits the installation of the bag cuff 69 without engaging and releasing the latch 62.

Figure 15:
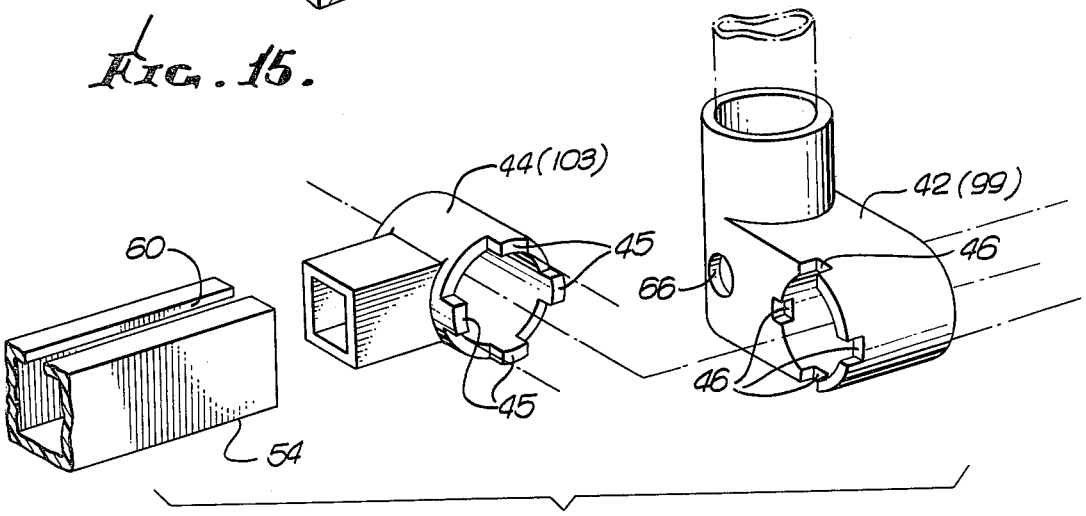
FIG. 15 is an exploded view of the latching cams of the bag holder of FIG. 8.

When wheels 65 are desired for portability an a axle shaft 64 shown on FIG. 8 is slidably assembled in the central frame subassembly 41 through a first receptacle 66 in the right hand fitting 99 as seen on FIG. 15 and through a similar second receptacle 66 (not shown) in the left hand fitting 98. The shaft 64 extends through the fittings 98 and 99 for rotatably holding a right hand wheel 65 adjacent fitting 99 and a left hand wheel 65 adjacent fitting 98. The wheels 65 and the shaft 64 are retained in place by a snap ring 84 at each end of the shaft 64.

A cover 67 is removably stowed on the back of the frame 90 as shown on FIG. 9. Cover 67 is contained at its lower edge by a pair of L shaped upward facing hooks 73 attached to the side members 91 and is held at its upper part by a pair of L shaped downward facing hooks 72 attached to the side members 91 for slidably engaging two mating receptacles 55 in the upper edge of the cover 67. A vertical shaft 58 on each of the hooks 72 is of sufficient length that the engaged cover 67 may be lifted to swing over the lower hooks 73 and drop away from the upper hooks 72.

Figure 1:
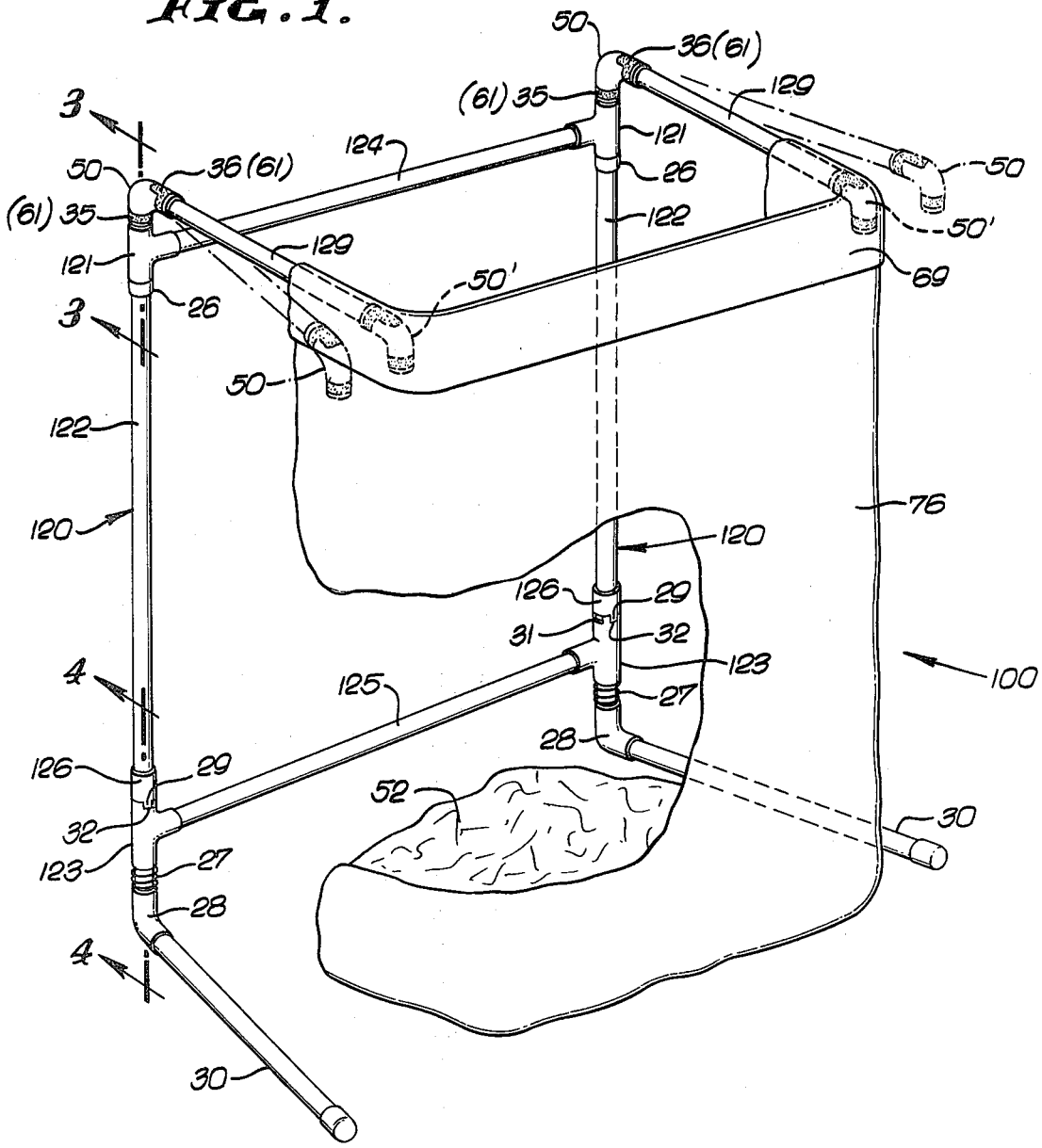
FIG. 1 is a perspective view of a first embodiment of a bag holder having a set of fixed elbow type corner grip knobs supported by a resiliently deflectable foldable frame for holding a bag in accordance with the invention.

In further reference to the drawings, FIG. 1 shows a perspective view of an alternate bag holder assembly 100 for light duty use constructed and being used in accordance with the principles of the invention to hold the bag 76 for filling with the bag load 52 by resiliently tensioning the bag cuff 69 over four of an integral elbow corner grip 50 having a peripheral grip surface 35 and a snubber grip surface 36. Identical generally C shaped side frame subassemblies 120 are foldably interconnected by an upper cross member 124 having a bearing 121 at each end and by a lower cross member 125 having a bearing 123 at each end. The upper cross member 124 also serves as a handle.

Each generally C shaped subassembly 120 has a vertical shaft 122 with a horizontal support arm 129 rigidly connected at its upper end by a rear elbow corner grip 50, and has a horizontal support foot 30 aligned generally parallel to the support arm 129 rigidly connected at its lower end by an elbow 28. Each horizontal support arm 129 has a second elbow corner grip 50 at its outer end, thus disposing four of the elbow corner grips in the bag holder assembly for holding the bag cuff with a generally rectangular bag opening.

Figure 3:
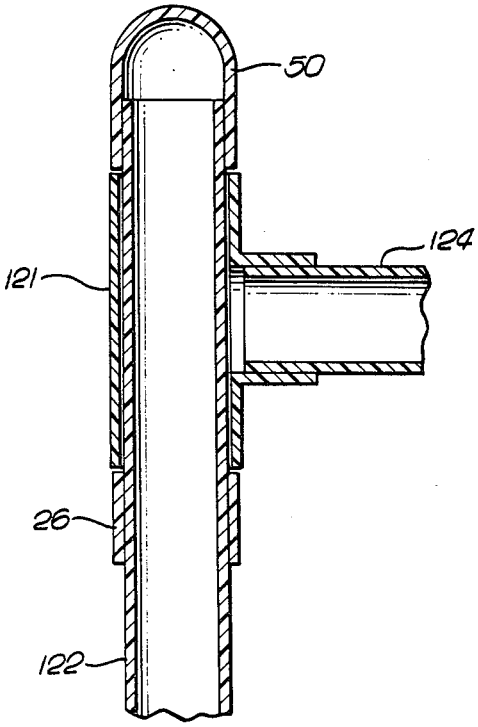
FIG. 3 is a sectional view on an enlarged scale taken along line 3—3 on FIG. 1.

Each side frame subassembly hinges on the vertical shaft 122 which is rotatably held at its upper part in the end bearing 121 rigidly connected on the end of upper cross arm 124 and is rotatably and slidably held at its lower part by the end bearing 123 rigidly connected on the end of the lower cross arm 125. As seen on FIG. 3, the end bearing 121 is held from sliding on the vertical shaft 122 by the elbow corner grip 50 and by a shaft collar 26.

Figure 2:
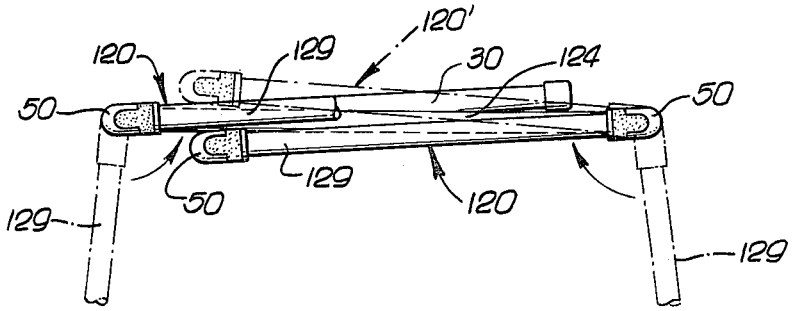
FIG. 2 is a top view of FIG. 1 showing the bag holder folded for storage.
Figure 4:
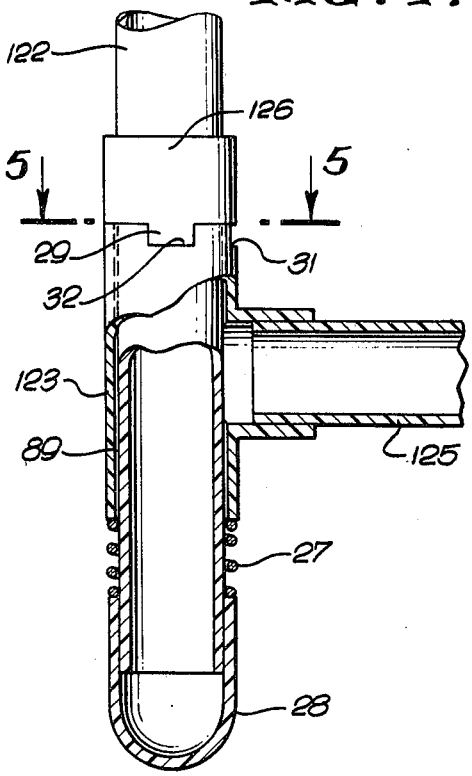
FIG. 4 is a sectional view on an enlarged scale taken along line 4—4 on FIG. 1.
Figure 5:
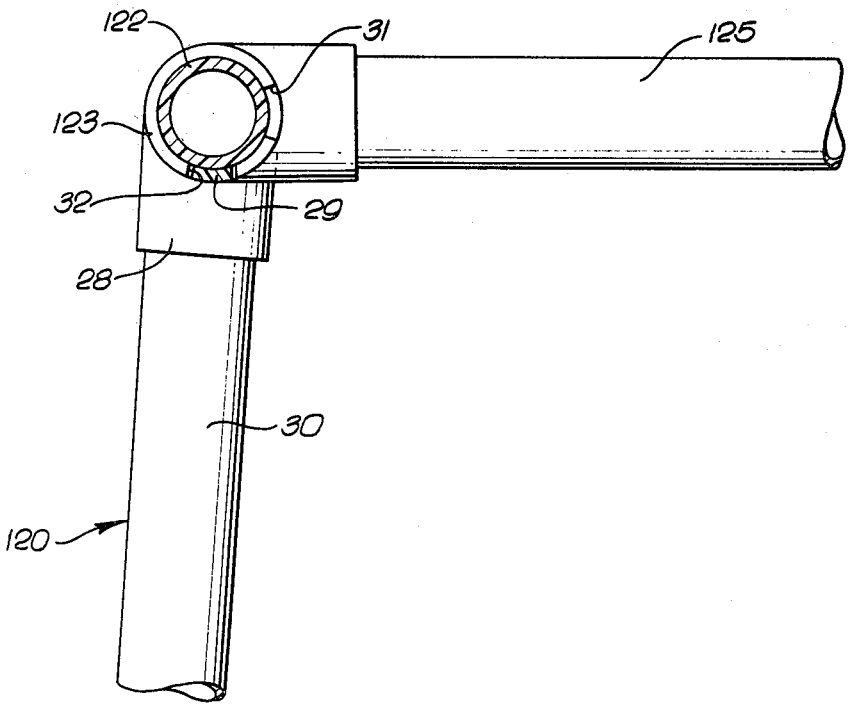
FIG. 5 is a sectional view on an enlarged scale taken along line 5—5 on FIG. 4 with the lock positioned to hold the bag holder open for use.

The manner of locking each side frame subassembly 120 in the open position shown on FIG. 1 or the folded position shown on FIG. 2 is detailed on FIG. 4. The bearing 123 is urged to slide upward on shaft 122 by a compressed spring 27 bearing against the top of the elbow 28 thereby urging engagement of a lock finger 29 on a shaft collar 126 into a cam recess 32 or an alternate cam recess 31 in the top of the bearing 123. A clearance 89 is provided in each bearing 123 to permit sufficient sliding of said bearing 123 on the mating shaft 122 without binding to engage or disengage the lock 29 in the cam recesses 32 or 31 while the lock 29 at the opposite end of the cross member 125 remains engaged. Engagement of the lock 29 in the cam recess 32 holds the associated side frame subassembly 120 fixed in the extended position as indicated on FIG. 5. Engagement of the lock 29 in the cam recess 31 holds the associated side frame subassembly 120 fixed in one of the folded positions for storage as shown on FIG. 2.

Figure 6:
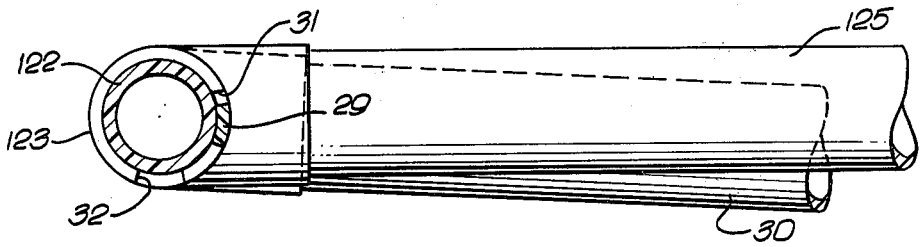
FIG. 6 is a sectional view on an enlarged scale taken along line 5—5 on FIG. 4 but showing the cam lock rotated to hold the bag holder closed for storage as in FIG. 2.
Figure 7:
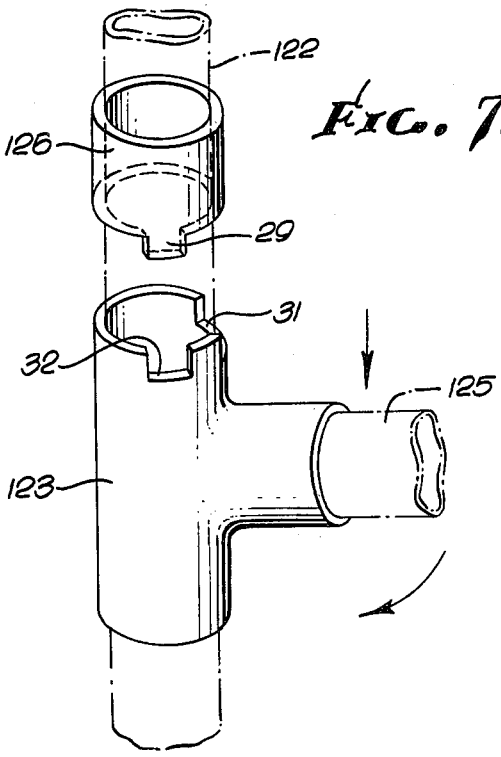
FIG. 7 is an exploded view on an enlarged scale of the male cam lock and its mating female cam recess receptacle to clarify FIG. 5.

As illustrated on FIG. 2, the side frame subassemblies 120 fold against each other at a small angle in the storage position. It can be seen that when the right hand side frame subassembly 120 is rotated lastly to the storage position it nests in the position shown, and when it is rotated before the left hand side frame subassembly 120 has been folded, it will nest in the alternate position indicated at 120'. As shown on FIG. 6, the cam recess 31 for the storage position is wider than the lock 29 by a sufficient amount so lock 29 may be held against either side of the cam recess 31 as determined by the order in which the side frame subassemblies 120 are folded, and is held in either position by the interlocking contact of the side frame subassemblies 120. The folding and locking detail may be more clearly understood by reference to FIG. 7 showing an exploded view of the lock 29 on the shaft collar 126 and the cam recesses 31 and 32 in the bearing 123.

The manner of resiliently deflecting the bag holder assembly 100 for installing the bag cuff 69 around the elbow corner grips 50 is best seen by reference to FIG. 1 which indicates the position of each deflected elbow corner grip 50 at 50'. Installation and tensioning of the cuff 69 over the four elbow corner grips 50 requires inward rotational deflection of the support arms 129 to provide controlled tensioning of the cuff 69 by the resilient outward urging of the two front elbow corner grips 50 when held in their deflected positions 50'. The bag 76 is installed by placing the cuff 69 over the two rear elbow corner grips 50 and one of the front elbow corner grips 50 and then pulling the fourth corner of the cuff 69 outwardly with one hand while deflecting the remaining front elbow corner grip 50 inwardly with the other hand for receiving the cuff 69. The rotational deflection of the support arms 129 for providing the nearly constant resilient tensioning of the cuff 69 is obtained partly by bending in the support arms 129 and in the lower cross member 125, but is mostly obtained by the torsional deflection of the vertical shafts 122 transmitted by rotation in the bearings 121. To insure uniform nearly constant controlled tensioning, an appreciable initial deflection is provided by the deflection members. The bag 76 is removable from the bag holder assembly 100 by deflecting the support arms 129 inwardly to release the cuff 69 from the elbow corner grips 50. The bag holder assembly 100 is for manufacture in different sizes for holding a particular standard size of the bag 76.

In accordance with the principles of the invention and as shown on FIG. 1, each elbow corner grip 50 has an initial grip surface 35 on its projecting vertical leg and has an adjacent coacting snubber grip surfaces 35 and 36 have a surfacing 61 for increasing the grip coefficient on the cuff 69. The initial grip surface 35 grips on the outer part of the cuff 69 in response to the resiliently urged peripheral tensioning, thereby retaining the empty bag 76 and initiating the self locking grip over the snubber grip surface 36 holding in the intermediate part of the cuff 69 when the bag 76 is loaded.

Figure 17:
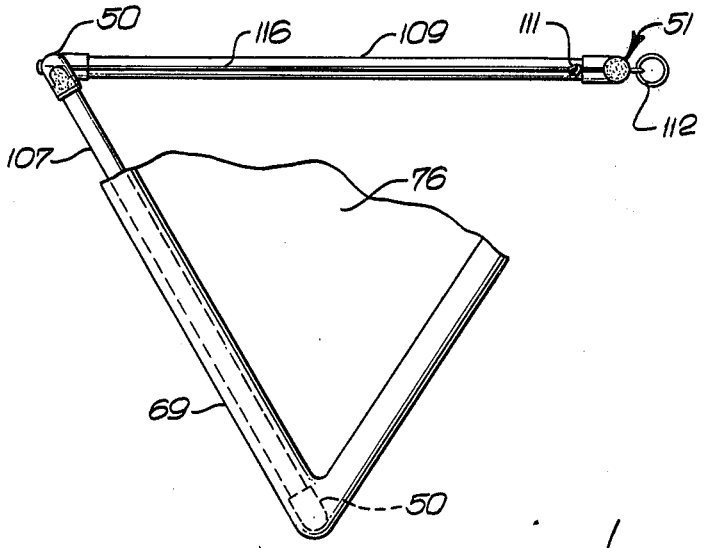
FIG. 17 is a top view of FIG. 16.
Figure 18:
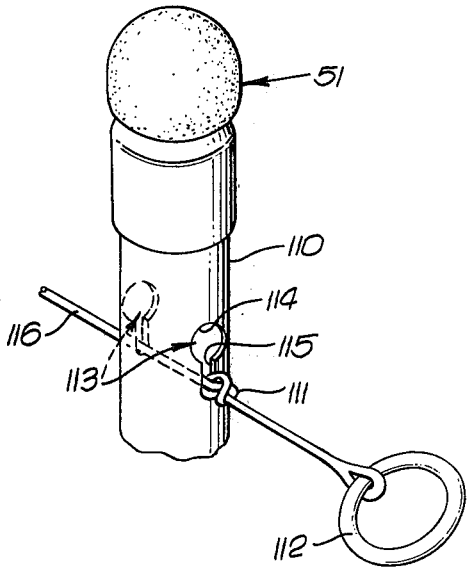
FIG. 18 is a fragmentary view of the upper end of the right hand leg of the frame as shown in FIG. 16.
Figure 16:
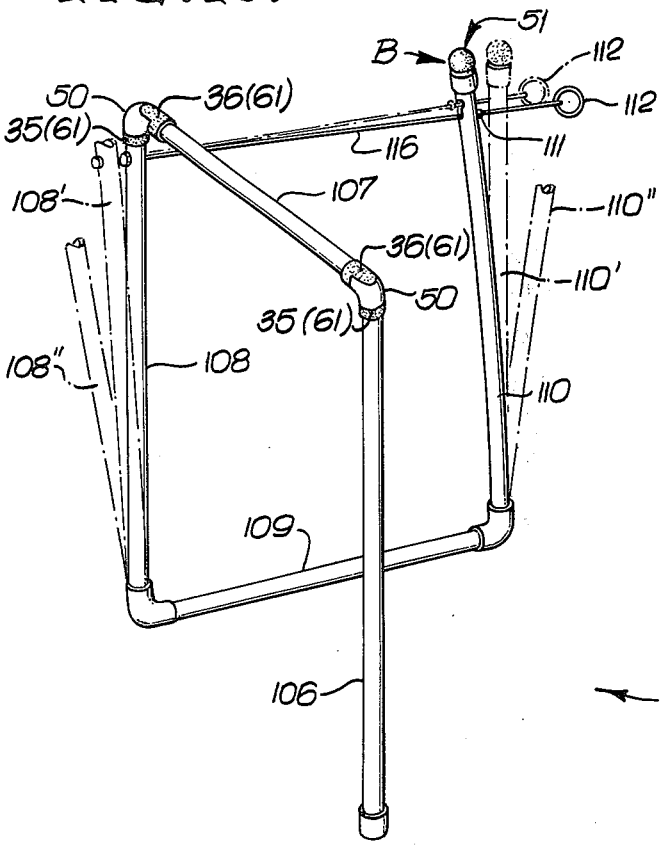
FIG. 16 is a perpective view of a third embodiment of light construction having a draw cord contracting the bag installation.

A second alternate bag holder assembly 105 as shown in perspective on FIG. 16 with added detail on FIGS. 17 and 18 utilizes the principles of the invention to obtain light weight construction and low cost manufacture, and holds the bag 76 by resiliently tensioning the cuff 69 on a pair of the elbow corner grips 50 and one rotatable knob corner subassembly 51 disposed for holding a triangular bag opening.

The bag holder assembly 105 has a vertical leg 106 rigidly connected at its top end by one of the elbow corner grips 50 to one end of a horizontal handle member 107. The horizontal handle member 107 is rigidly connected at its opposite end by a second elbow corner grip 50 to the top of a central vertical leg 103 that in turn integrally connects at its lower end to a horizontal foot support 109. The foot support 109 extends as seen in plan view on FIG. 18 at an angle with the handle member 107 for stabilizing the assembly 105. A vertical strut 110 connects integrally at the outer end of the foot support 109. The rotatable knob corner grip subassembly 51 connects at the top of the vertical strut 110 and provides for equalizing the tensioning of the cuff 69 between the elbow corner grips 50. As indicated on FIG. 16, the vertical leg 108 and strut 110 are constructed leaning outward as indicated at positions 108" and 110" to provide for the initial deflection for tensioning the cuff 69. The vertical legs 108 and 110 are held deflected through their initial deflections in the positions indicated at 108' and 110' by a latch cord 116. One end of the latch cord 116 connects to the upper part of the leg 108 and passes through an opening 113 in the upper part of the vertical strut 110 as shown on FIG. 18. The opening 113 has a lower slot 115 and an enlarged round part 114. A ring 112 connects at the free end of the latch cord 116 at such a cord length that when the ring 112 holds against the opening 113 the leg 108 and strut 110 are held deflected at their initial deflection positions 108' 110'. To install the bag 76, a latch bead 111 on the latch cord 116 is pulled through the round opening 114 and latched into the slot 111 by downward movement of the latch cord 116, thereby holding the leg 108 and strut 110 at their fully deflected positions and bringing the corner grips 50 and the rotatable knob subassembly 51 into position for free installation of the bag cuff 69. After the cuff 60 is installed, the latch bead 111 is slid upward in the slot 115 and released through round opening 114, thereby permitting the resiliently urged corner grip 50 and rotatable knob corner grip 51 to move outwardly and tension the installed bag cuff 69. The length of the latch cord 116 is such that the cuff 69 is tensioned before the latch cord ring 112 stops against the leg 110. For removal of the bag 76, the latch cord bead 111 is relatched against slot 111.

Figure 19:
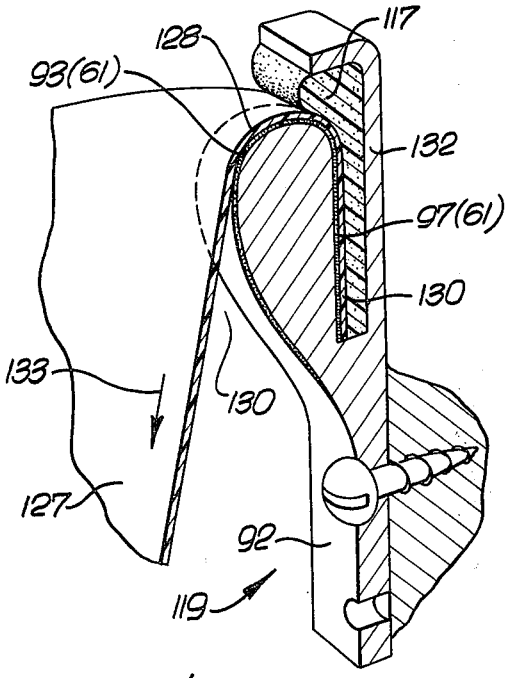
FIG. 19 is a fragmentary perspective cross sectional view of an alternate self locking grip for attaching to an overturned edge on a thin flexible sheet to a support.

A third alternate holder assembly 119 having a body 92 for attachment to a support, constructed in accordance with the principles of the invention as shown in FIG. 19, is for use singly or multiply for holding a thin flexible sheet 127 by gripping on localized areas on a folded border 128 and an outer part 130, as in a bag cuff, with a quickly releasable compound grip. The holder assembly 119 provides coacting grip surfaces 97 and 93 for supporting a load 133 on the sheet 127, as indicated by the arrow 133, with a locking action grip. Note that the support for holding assembly 119 may be turned to hold the sheet 127 at different angles to the vertical.

A soft resilient pressure pad 117 is attached on a bracket 132 disposed on the body 92 for pressing the pad 117 against the opposite initial grip surface 97 to provide for the low force initial grip on the outer part 130 of the sheet 127. The sheet 127 is installed in the holder assembly 119 by pulling the outer part 130 between the initial grip surface 97 and the resilient soft pressure pad 117. While carrying load 130, the sheet 127 is quickly releasable by lifting the outer part 133 from between the resilient pad 117 and the initial grip surface 97. Note that the resilient pad 117 is equivalent to the cuff tensioning means in the alternate multiple corner grip constructions. The smoothly curved snubber grip surface 93 of appreciable area for holding and distributing load 133 in the flexible sheet 127 is of generally semicircular section to provide a locking action snubbing grip and is adjacent the initial grip surface. The sheet 127 holding the load 133 is initially anchored by the low force grip on the initial grip surface 97 and is subsequently held from sliding by the exponentially increasing locking action snubbing grip caused by additive grip forces over the rounded snubber grip surface 93. A grip surfacing 61 on the grip surfaces 97 and 93 providing for a high grip coefficient on the thin flexible sheet 127 assures a self locking grip over the snubber grip surface 93 to retain the sheet 127 by holding up to the failure load for the sheet material without slipping.

I claim:

1. In combination with a bag holder having a frame disposing a cuff support with a cuff attachment means for holding a plastic film bag in an open position for filling by supporting in a cuff folded around the bag opening, the bag holder being of the type wherein peripherally tensioning the outer part of the cuff on the cuff attachment means provides for frictional retention of the bag, the improvement which comprises:

(a) an expandable cuff support capable of appreciable movement to provide nearly constant peripheral tensioning of the outer part of the cuff;

(b) means for resiliently urging expansion of the cuff support with a nearly constant force over a working distance sufficient to allow for manufacturing variations in the bag and the holder and for variable stretching of the cuff:

(c) at least three corner grips mounted on the expandable cuff support for holding the cuff of the bag open and at least one of which is freely rotatable for automatically equalizing the tension in said cuff;

(d) a smoothly curved initial grip surface of appreciable area, disposed to hold the outer part of the cuff peripherally tensioned to provide an initial grip for retaining the empty bag in place thereon;

(e) a smoothly curved snubber grip surface of appreciable area disposed adjacent the initial grip surface for holding in the fold of the cuff with a snubbing grip anchored by the initial grip and increasing over the snubber grip surface in response to a bag load to provide for self locking snubber grip thereon; and (f) a grip surfacing, adhered or integral, on said corner grips for providing a high grip coefficient on the bag material to obtain the self locking snubber grip thereon.

2. A bag holder as in claim 1 wherein the grip surfacing on the grip surfaces has closely spaced grit-like sharp points of a selected spacing, height, and sharpness for denting and immovably gripping the bag material.

3. A bag holder as in claim 1 wherein the corner grip is a projecting knob having a generally hemispherical head removably attachable to the cuff support.

4. A bag holder as in claim 3 wherein the cuff support has means for attaching said corner grips at alternate positions for holding bags having different sized inlet openings.

5. A bag holder for supporting and holding a plastic film bag open during filling comprising:

means swivelly supporting each of more than two upright bag grippers urged resiliently apart in a generally horizontal plane and positioned to engage and place the full girth of the overturned open end of a plastic film bag of any of a range of different girths resiliently in hoop tension while being filled and which bag supporting means are foldable when not in use to generally co-planar position; and said bag grippers each having a rounded grit-like surface consisting of a multiplicity of closely spaced sharp projections fixed thereto and distributed thereover in all directions, said grit-like projections being positioned and sized to protrude into and grip the overturned open end of a plastic bag without damaging or puncturing the plastic film while the bag is being filled.

6. A bag holder as defined in claim 5 characterized in the provision of means movably supporting at least one of said bag grippers for movement in a direction to equalize the hoop tension in the overturned open end of a plastic bag when supported on said bag holder.

7. A bag holder as defined in claim 5 or 6 characterized in that said bag support means includes means for adjusting the spacing between said bag grippers to accommodate bags having open ends of different circumferential sizes.

8. A bag holder as defined in claim 5 characterized in that said bag support means is self-supporting and includes uprights arranged to support said bag grippers at a suitable height for filling a bag with the major length thereof suspended centrally between said grippers with the rim portion of its open end overturned thereover.

9. A bag holder as defined in claim 5 characterized in that said uprights and said bag gripper support means include means for folding the same compactly together when not in use and for holding the same firmly extended to support a bag at other times.

10. A bag holder as defined in claim 5 characterized in that said bag support means includes three upright legs two of which are interconnected between the lower ends thereof and two of which are interconnected between the upper ends thereof, and rotary coupling means operatively associated with one of said legs permitting the other two of said legs to be swivelled toward and away from one another between a collapsed storage position of said device and the expanded bag-supporting position thereof.

11. A bag holder as defined in claim 5 characterized in the provision crosswise of the lower end of said bag support means of carriage wheels to facilitate movement of said bag holder from place to place.

12. A bag holder as defined in claim 5 characterized in that said bag support means includes a pair of generally horizontal cantilever arms underlying and supporting said upright bag grippers suitably positioned to hold the open overturned end of a bag in hoop tension.

13. A bag holder as defined in claim 12 characterized in the provision of means for adjusting the spacing between said bag grippers to accommodate different size bag openings.

14. A bag holder as defined in claim 12 characterized in that said bag support means is adjustable in height to accommodate bags of different lengths.

15. A collapsible self-supporting bag holder for use in firmly supporting plastic film bags while being filled comprising:

folding main frame means having a plurality of uprights pivotally connected for movement between collapsed and extended positions and including means for holding said uprights firmly and resiliently extended; and a plurality of upright bag grippers at one end of said main frame having areas thereof covered with a multiplicity of grit-like projections spaced to cooperate in holding the overturned open end of a plastic bag resiliently in firm hoop tension and effective to retain the same firmly captive and against slippage thereover while being filled, and at least one of which bag grippers is freely rotatable about an upright axis and thereby effective to equalize the hoop tension in the overturned open end of said bag.

16. A bag holder as defined in claim 15 characterized in that portions of the bag contacting surfaces of said bag grippers are coated with sharp edged particles effective to grip the tensioned overturned portion of a bag without piercing or damaging the same.

17. A bag holder for a plastic film bag as defined in claim 15 characterized in that at least one of said plurality of bag grippers is freely rotatable about an upright axis to equalize the hoop tension of a bag having the open end thereof overturned about said bag grippers.

18. An article of manufacture comprising a bag gripper for use in multiple to hold a plastic film bag open while being filled without rupturing or tearing the open end thereof, said bag gripper comprising:

a main body movably supported on one end of said spindle means the opposite end of which spindle means is adapted to be rotatably mounted on bag support means; and the sides and end surfaces of said main body remote from said spindle means having a multiplicity of sharp grit-like projections fixed thereto and distributed in all directions and effective to grip and firmly hold the overturned open end of a tensioned plastic film bag in immovable contact therewith without piercing or damaging said plastic film.

19. An article of manufacture as defined in claim 18 characterized in that said main body is generally spherical and freely rotatable about the axis of said spindle means.

20. An art of manufacturing as defined in claim 18 characterized in that the portion of said main body provided with said grit-like projections is rounded and curvilinear in all directions.

* * * * *

UNITED STATES PATENT AND TRADEMARK OFFICE

CERTIFICATE OF CORRECTION

PATENT NO. : 4,304,378

DATED : December 8, 1981

INVENTOR(S) : Earl C. Briggs

It is certified that error appears in the above-identified patent and that said Letters Patent are hereby corrected as shown below:

Column 14

Claim 17, line 2, change "15" to --5--

Claim 18, line 5, delete the word "said"

Signed and Sealed this

Sixth Day of July 1982

[SEAL]

Attest:

GERALD J. MOSSINGHOFF

Attesting Officer

Commissioner of Patents and Trademarks